US006013609A

United States Patent [19]

Katafuchi

[11] Patent Number: 6,013,609

[45] Date of Patent: Jan. 11, 2000

[54] REFRIGERATOR OIL AND PROCESS FOR LUBRICATION USING THE REFRIGERATOR OIL

[75] Inventor: Tadashi Katafuchi, Ichihara, Japan

[73] Assignee: Idemitsu Kosan Co., Ltd., Tokyo, Japan

[21] Appl. No.: 08/973,876

[22] PCT Filed: Jul. 1, 1996

[86] PCT No.: PCT/JP96/01817

§ 371 Date: Jan. 7, 1998

§ 102(e) Date: Jan. 7, 1998

[87] PCT Pub. No.: WO97/03153

PCT Pub. Date: Jan. 30, 1997

[30] Foreign Application Priority Data

Jul. 10, 1995 [JP] Japan ..... 7-173522

[51] Int. Cl.[7] ..... C10M 155/02

[52] U.S. Cl. ..... 508/206; 252/68

[58] Field of Search ..... 508/206; 252/68

[56] References Cited

U.S. PATENT DOCUMENTS

| | | | |
|---|---|---|---|
| 4,946,611 | 8/1990 | Kaneko | 508/206 |
| 5,378,385 | 1/1995 | Thomas et al. | 252/68 |
| 5,384,057 | 1/1995 | Wilczek | 252/68 |
| 5,595,962 | 1/1997 | Caporiccio et al. | 508/206 |
| 5,747,430 | 5/1998 | Matsushita et al. | 508/206 |
| 5,766,513 | 6/1998 | Pillon et al. | 508/206 |

FOREIGN PATENT DOCUMENTS

| | | |
|---|---|---|
| 57-159892 | 10/1982 | Japan . |
| 59-105091 | 6/1984 | Japan . |
| 1-118598 | 5/1989 | Japan . |
| 1-193393 | 8/1989 | Japan . |
| 2-127498 | 5/1990 | Japan . |
| WO96/03480 | 2/1996 | WIPO . |

OTHER PUBLICATIONS

Derwent Abstract C92–043079 of JP 4–36388; Feb. 6, 1992.
Derwent Abstract C92–043078 of JP 4–36387; Feb. 6, 1992.

*Primary Examiner*—Jerry D. Johnson
*Attorney, Agent, or Firm*—Oblon, Spivak, McClelland, Maier & Neustadt, P.C.

[57] ABSTRACT

A refrigerator oil, particularly a refrigerator oil for a hydrofluorocarbon refrigerant, comprising a base oil composed of an oxygen-containing organic compound, such as a polyalkylene glycol and polyester, and a fluorinated silicone oil having a kinematic viscosity of 500 $mm^2$/sec or more at 25° C. is disclosed. A process for lubrication of a refigeration system comprising lubricating a compression-type refrigeration system by using the refrigerator oil is also disclosed.

By using the refrigerator oil, the foaming phenomenon during boiling of the refrigerant dissolved in the refrigerator oil can effectively be suppressed. In the refrigeration system using the refrigerator oil, effective lubrication can be achieved.

4 Claims, No Drawings

REFRIGERATOR OIL AND PROCESS FOR LUBRICATION USING THE REFRIGERATOR OIL

TECHNICAL FIELD

The present invention relates to a refrigerator oil, particularly a refrigerator oil for use in combination with a hydrofluorocarbon refrigerant, and a process for lubrication of a refrigeration system using the refrigerator oil. More particularly, the present invention relates to a refrigerator oil which can effectively suppress the foaming phenomenon during boiling of the refrigerant dissolved in the refrigerator oil, and a process for lubrication of a refrigeration system using the refrigerator oil to maintain the excellent performance of a compression-type refrigeration system.

BACKGROUND ART

Compression-type refrigerators are generally constituted with a compressor, a condenser, an expansion valve and an evaporator, and has a structure in which a mixed fluid of a refrigerant and a lubricating oil is circulated in the closed system. Heretofore, in the compression-type refrigerators, dichlorofluoromethane (R12), chlorodifluoromethane (R22) or the like has mainly been used as the refrigerant, and various types of mineral oil and synthetic oil have been used as the lubricant.

However, chlorofluorohydrocarbons, such as R12 and R22 described above, are being more rigorously restricted world-wide because they bring environmental pollution such as the ozonosphere destruction. By this reason, hydrogen-containing Flon compounds [a "Flon compound" means a chlorofluorocarbon, a hydrofluorocarbon, and a hydrochlorofluorocarbon in general] such as hydrofluorocarbons and hydrochlorofluorocarbons are attracting attention as the novel types of refrigerant. The hydrogen-containing fluorocarbons, particularly hydrofluorocarbons, such as 1,1,1,2-tetrafluoroethane (Flon 134a), are preferred as the refrigerant for compression-type refrigerators because they have little possibility of causing the ozonosphere destruction and can replace Flon 12 with little change in the structure of refrigerators which have heretofore been used.

However, when the hydrofluorocarbon refrigerant described above is used, an unfavorable phenomenon that foaming takes place to a great extent during boiling of the refrigerant dissolved in the refrigerator oil occurs. The foaming phenomenon takes place to a greater extent particularly when a mixed refrigerant containing two or more types of hydrofluorocarbon is used. When the foaming phenomenon occurs to a great extent, a large amount of the refrigerator oil flows into the refrigeration system to cause problems that the refrigerating ability is decreased and that the sufficient lubrication is not achieved because of decrease in the amount of the refrigerator oil at the places requiring lubrication. Particularly when a refrigerator of a recent type equipped with an inverter is used, the problems are greater because a higher speed of rotation is required at the start of the operation. Therefore, a refrigerator oil which can prevent the foaming phenomenon is required more for a refrigerator of this type than for refrigerators of previous types.

The same phenomenon has also been observed with refrigerants of previous types. It has empirically been known that the foaming phenomenon in the refrigerants of previous types can be suppressed by adding a conventional silicone oil. However, it is the current situation that, when a hydrofluorocarbon refrigerant is used, the addition of a conventional silicone shows such limited effect of suppressing the foaming phenomenon that no practical effect can be expected.

DISCLOSURE OF THE INVENTION

An object of the present invention is to provide a refrigerator oil, particularly a refrigerator oil for use in combination with a hydrofluorocarbon refrigerant, which can effectively suppress the foaming phenomenon during boiling of the refrigerant dissolved in the refrigerator oil.

Another object of the present invention is to provide a process for lubrication of a refrigeration system using the above refrigerator oil to maintain the excellent performance of a compression-type refrigeration system.

The present inventors studied extensively to achieve the objects described above. As the result of such studies, it was discovered that, when a fluorinated silicone oil is added to a specific refrigerator oil, the foaming phenomenon during boiling of a refrigerant dissolved in the refrigerator oil can effectively be suppressed. It was also discovered that, in a compression-type refrigeration system, the excellent performance of the refrigeration system can be maintained by lubricating the refrigeration system with the refrigerator oil containing the fluorinated silicone oil described above. The present invention has been completed on the basis of the discoveries.

Accordingly, the present invention provides a refrigerator oil comprising a base oil composed of an oxygen-containing organic compound and a fluorinated silicone oil having a kinematic viscosity of 500 $mm^2$/sec or more at 25° C. The present invention also provides a process for lubrication of a refrigeration system comprising lubricating a compression-type refrigeration system by using the refrigerator oil described above.

THE MOST PREFERRED EMBODIMENT TO CARRY OUT THE INVENTION

In the present invention, the fluorinated silicone oil contained in the refrigerator oil has a kinematic viscosity of 500 $mm^2$/sec or more at 25° C. For example, a fluorinated silicone oil having the structure represented by the general formula (I):

(I)

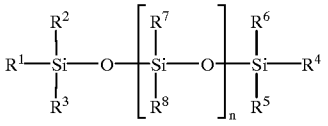

is preferably used.

In the general formula (I), $R^1$ to $R^6$ represent each hydrogen atom, a hydrocarbon group, or a fluorinated hydrocarbon group, and may be the same with each other or different from each other. $R^7$ and $R^8$ represent each a hydrocarbon group or a fluorinated hydrocarbon group, and at least one of $R^7$ and $R^8$ is a fluorinated hydrocarbon. Examples of the hydrocarbon group represented by $R^1$ to $R^8$ include alkyl groups having 1 to 20 carbon atoms, cycloalkyl groups having 5 to 20 carbon atoms, aryl groups having 6 to 20 carbon atoms, and aralkyl groups having 7 to 20 carbon atoms. Examples of the fluorinated hydrocarbon group include fluorinated alkyl groups having 1 to 20 carbon atoms, fluorinated cycloalkyl groups having 5 to 20 carbon atoms, fluorinated aryl groups having 6 to 20 carbon atoms, and fluorinated aralkyl groups having 7 to 20 carbon atoms. Particularly, alkyl groups having 1 to 20 carbon atoms and fluorinated alkyl groups having 1 to 20 carbon atoms are preferable as the hydrocarbon group and the fluorinated hydrocarbon group, respectively, because the solubility in the refrigerator oil is low and the effect of suppressing the foaming phenomenon is great.

$R^7$ and $R^8$ in a plurality of repeating units may be the same with each other or different from each other. n represents an integer which is selected in such a manner that the fluorinated silicon oil has a kinematic viscosity of 500 $mm^2$/sec or more at 25° C.

The alkyl group having 1 to 20 carbon atoms described above may be linear or branched. Specific examples of the alkyl group having 1 to 20 carbon atoms include methyl group, ethyl group, n-propyl group, isopropyl group, n-butyl group, isobutyl group, sec-butyl group, t-butyl group, various types of pentyl group, various types of hexyl group, various types of octyl group, various types of decyl group, and various types of dodecyl group. Examples of the cycloalkyl group having 5 to 20 carbon atoms include cyclopentyl group, cyclohexyl group, and methylcyclohexyl group. Examples of the aryl group having 6 to 20 carbon atoms include phenyl group. tolyl group, xylyl group, and naphthyl group. Examples of the aralkyl group having 7 to 20 carbon atoms include benzyl group, phenetyl group, and naphthylmethyl group. Examples of the fluorinated alkyl group having 1 to 20 carbon atoms, the fluorinated cycloalkyl groups having 5 to 20 carbon atoms, the fluorinated aryl groups having 6 to 20 carbon atoms, and the fluorinated aralkyl group having 7 to 20 carbon atoms include groups obtained by substituting one or more hydrogen atoms in the alkyl groups, the cycloalkyl groups, the aryl groups, and the aralkyl groups, respectively, described above with fluorine atoms.

When the fluorinated silicone oil represented by the general formula (I) has a kinematic viscosity of less than 500 $mm^2$/sec at 25° C., the effect of suppressing the foaming phenomenon is insufficient, and the fluorinated silicone oil is not preferable. For exhibiting a sufficient effect of suppressing the foaming phenomenon, the kinematic viscosity at 25° C. is preferably 1,000 $mm^2$/sec or more, more preferably 9,000 $mm^2$/sec or more (n is generally more than 100).

The content of the fluorinated silicone oil is not particularly limited. When a hydrofluorocarbon refrigerant is used as the refrigerant, the content is preferably in the range that the compatibility of the refrigerator oil and the refrigerant is not adversely affected. More specifically, the content is preferably in the range of 1 to 6,000 ppm by weight, more preferably in the range of 10 to 3,000 ppm by weight. When the content is less than 1 ppm by weight, the effect of suppressing the foaming phenomenon is sometimes not sufficiently exhibited. When the content is more than 6,000 ppm by weight, the refrigerator oil occasionally becomes cloudy. In view of the effect of suppressing the foaming phenomenon and the stability, it is preferred that the fluorinated silicone oil is contained in such an amount that the product of the kinematic viscosity ($mm^2$/sec) of the fluorinated silicone oil at 25° C. and the content (ppm by weight) of the fluorinated silicone oil in the refrigerator oil is in the range of 50,000 to 3,000,000, more preferably in the range of 100,000 to 2,000,000. When the product is less than 50,000, the effect of suppressing the foaming phenomenon tends to become small. When the product is more than 3,000,000, there is the possibility that the refrigerator oil becomes cloudy.

The refrigerator oil of the present invention is used in combination with various types of refrigerant, preferably in combination with a hydrofluorocarbon refrigerant. When a hydrofluorocarbon refrigerant is used as the refrigerant, the base oil of the refrigerator oil is not particularly limited as long as the base oil has a good compatibility with the hydrofluorocarbon refrigerant. Specifically, oxygen-containing organic compounds are preferable as the base oil because of the good compatibility with hydrofluorocarbon refrigerants.

Examples of the oxygen-containing organic compound include (1) polyalkylene glycols, (2) polyesters, (3) polyol esters, (4) polyether ketones, (5) polyvinyl ethers, and (6) carbonate derivatives.

As (1) the polyalkylene glycol described above, for example, a compound represented by the general formula (II):

$$R^9—[(OR^{10})_m—OR^{11}]_k \quad \text{(II)}$$

(wherein $R^9$ represents hydrogen atom, an alkyl group having 1 to 10 carbon atoms, an acyl group having 2 to 10 carbon atoms, or an aliphatic hydrocarbon group having 1 to 10 carbon atoms and 2 to 6 parts for bonding; $R^{10}$ represents an alkylene group having 2 to 4 carbon atoms; $R^{11}$ represents hydrogen atom, an alkyl group having 1 to 10 carbon atoms, or an acyl group having 2 to 10 carbon atoms; k represents an integer of 1 to 6; and m represents a number which is selected in such a manner that the average of m×k is 6 to 80) can be used.

In the above general formula (II), the alkyl group represented by $R^9$ and $R^{11}$ may be linear, branched linear, or cyclic. Specific examples of the alkyl group include methyl group, ethyl group, n-propyl group, isopropyl group, various types of butyl group, various types of pentyl group, various types of hexyl group, various types of heptyl group, various types of octyl group, various types of nonyl group, various types of decyl group, cyclopentyl group, and cyclohexyl group. When the number of carbon atom in the alkyl group is more than 10, the compatibility with hydrofluorocarbon refrigerants is decreased, and phase separation occasionally takes place. The preferable number of carbon atom in the alkyl group is 1 to 6.

The alkyl group in the acyl group represented by $R^9$ and $R^{11}$ may be linear, branched linear, or cyclic. Specific examples of the alkyl group include alkyl groups having 1 to 9 carbon atoms selected from the alkyl groups described as the examples of the alkyl group in the above. When the number of carbon atom in the acyl group is more than 10, the compatibility with hydrofluorocarbon refrigerants is decreased, and phase separation occasionally takes place. The preferable number of carbon atom in the alkyl group is 2 to 6.

When $R^9$ and $R^{11}$ are both alkyl groups or acyl groups, $R^9$ and $R_{11}$ may be the same or different.

When k is 2 or more, the plurality of Rll in one molecule may be the same with each other or different from each other.

When $R^9$ is an aliphatic hydrocarbon group having 1 to 10 carbon atoms and 2 to 6 parts for bonding, the aliphatic hydrocarbon group may be an open-chain group or a cyclic group. Examples of the aliphatic hydrocarbon group having 2 parts for bonding include ethylene group, propylene group, butylene group, pentylene group, hexylene group, heptylene group, octylene group, nonylene group, decylene group, cyclopentylene group, and cyclohexylene group. Examples of the aliphatic hydrocarbon group having 3 to 6 parts for bonding include residue groups formed by eliminating hydroxyl groups from polyhydric alcohols, such as trimethylpropane, glycerol, pentaerythritol, sorbitol, 1,2,3-trihydroxycylohexane, and 1,3,5-trihydroxycyclohexane.

When the number of carbon atom in the aliphatic hydrocarbon group is more than 10, the compatibility with hydrofluorocarbon refrigerants is decreased, and phase separation occasionally takes place. The preferable number of carbon atom in the alkyl group is 2 to 6.

$R^{10}$ in the above general formula (II) represents an alkylene group having 2 to 4 carbon atoms. Examples of the oxyalkylene group as the repeating unit include oxyethylene group, oxypropylene group, and oxybutylene group. A single type of the oxyalkylene group or 2 or more types of the oxyalkylene group may be contained in one molecule. It is preferred that at least the oxypropylene unit is contained in one molecule. It is particularly preferred that 50% by mol or more of the oxypropylene unit is contained in the oxyalkylene unit.

k in the above general formula (II) represents an integer of 1 to 6 which is determined in accordance with the number of the part for bonding in $R^9$. For example, when $R^9$ represents an alkyl group or an acyl group, k represents 1. When $R^9$ represents an aliphatic hydrocarbon group having 2, 3, 4, 5, or 6 parts for bonding, k represents 2, 3, 4, 5, or 6, respectively. m represents a number which is selected in such a manner that the average of m×k is 6 to 80, preferably 10 to 70. When the average of m×k is at the outside of the above range, the objects of the present invention cannot sufficiently be achieved.

The polyalkylene glycol represented by the general formula (II) include polyalkylene glycols having hydroxyl groups at the end. When the content of the hydroxyl group at the end is 50% by mol or less of the total end groups, the polyalkylene glycol containing the hydroxyl group at the end can advantageously be used. However, when the content of the hydroxyl group at the end is more than 50% by mol, the polyalkylene glycol is not preferable because the polyalkylene glycol becomes more hygroscopic and the viscosity index is decreased.

As the polyalkylene glycol described above, polyoxypropylene glycol dimethyl ethers represented by the general formula:

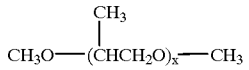

(wherein x represents a number of 6 to 80), polyoxyethylene polyoxypropylene glycol dimethyl ethers represented by the general formula:

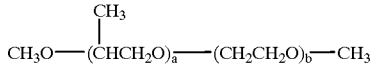

(wherein a and b represent each a number of 1 or more, and the sum of a and b is 6 to 80), polyoxypropylene glycol monobutyl ethers represented by the general formula:

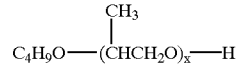

wherein x represents a number of 6 to 80), and polyoxypropylene glycol diacetate, are preferable in view of the economy and the effect.

As the polyalkylene glycol represented by the general formula (II), compounds described in the specification of Japanese Patent Application Laid-Open No. Heisei 2(1990)-305893 in detail can also be used.

As (2) the polyester described above, an aliphatic polyester derivative having a constituting unit represented by the general formula (III):

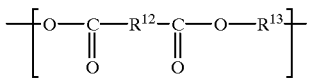

(III)

(wherein $R^{12}$ represents an alkylene group having 1 to 10 carbon atoms, and $R^{13}$ represents an alkylene group having 2 to 10 carbon atoms or an oxaalkylene group having 4 to 20 carbon atoms) and a molecular weight of 300 to 2000 can be used.

In the general formula (III), $R^{12}$ represents an alkylene group having 1 to 10 carbon atoms. Specific examples of the alkylene group include methylene group, ethylene group, propylene group, ethylmethylene group, 1,1-dimethylethylene group, 1,2-dimethylethylene group, n-butylethylene group, isobutylethylene group, 1-ethyl-2-methylethylene group, 1-ethyl-1-methylethylene group, trimethylene group, tetramethylene group, and pentamethylene group. Alkylene groups having 6 or less carbon atoms are preferable. $R^{13}$ represents an alkylene group having 2 to 10 carbon atoms or an oxaalkylene group having 4 to 20 carbon atoms. Specific examples of the alkylene group include the groups described above as the specific examples of the alkylene group represented by $R^{12}$ (except for methylene group). Alkylene groups having 2 to 6 carbon atoms are preferable. Specific examples of the oxaalkylene group include 3-oxa-1,5-pentylene group, 3,6-dioxa-1,8-octylene group, 3,6,9-trioxa-1,11-undecylene group, 3-oxa-1,4-dimethyl-1,5-pentylene group, 3,6-dioxa-1,4,7-trimethyl-1,8-octylene group, 3,6,9-trioxa-1,4,7,10-tetramethyl-1,11-undecylene group, 3-oxa-1,4-diethyl-1,5-pentylene group, 3,6-dioxa-1,4,7-triethyl-1,8-octylene group, 3,6,9-trioxa-1,4,7,10-tetraethyl-1,11-undecylene group, 3-oxa-1,1,4,4-tetramethyl-1,5-pentylene group, 3,6-dioxa-1,1,4,4,7,7-hexamethyl-1,8-octylene group, 3,6,9-trioxa-1,1,4,4,7,7,10,10-octamethyl-1,1,1-undecylene group, 3-oxa-1,2,4,5-tetramethyl-1,5-pentylene group, 3,6-dioxa-1,2,4,5,7,8-hexamethyl-1,8-octylene group, 3,6,9-trioxa-1,2,4,5,7,8,10,11-octamethyl-1,1,1-undecylene group, 3-oxa-1-methyl-1,5-pentylene group, 3-oxa-1-ethyl-1,5-pentylene group, 3-oxa-1,2-dimethyl-1,5-pentylene group, 3-oxa-1-methyl-4-ethyl-1,5-pentylene group, 4-oxa-2,2,6,6-tetramethyl-1,7-heptylene group, and 4,8-dioxa-2,2,6,6,10,10-hexamethyl-1,11-undecylene group. $R^{12}$ and $R^{13}$ in a plurality of constituting units may be the same with each other or different from each other.

The aliphatic polyester derivative represented by the above general formula (III) preferably has a molecular weight (measured by the gel permeation chromatography (GPC)) of 300 to 2,000. When the molecular weight is less than 300, the kinematic viscosity is smaller than the desirable range. When the molecular weight is more than 2,000, the aliphatic polyester derivative becomes waxy. Therefore, a molecular weight at the outside of the specified range is not preferable.

As the aliphatic polyester derivative described above, the compounds described in the specification of International Patent Application Laid-Open No. WO 91/07479 in detail can also be used.

As (3) the polyol ester described above, a carboxylic acid ester of a polyhydric hydroxy compound containing at least 2 hydroxyl groups can be used. For example, a compound represented by the general formula (IV):

$$R^{14}[OCOR^{15}]_e \quad \text{(IV)}$$

can be used.

In the above general formula (IV), $R^{14}$ represents a hydrocarbon group which may be linear or branched linear, preferably an alkyl group having 2 to 10 carbon atoms. $R^{15}$ represents hydrogen atom or a hydrocarbon group having 1 to 22 carbon atoms, preferably an alkyl group having 2 to 16 carbon atoms. e represents an integer of 2 to 6 . A plurality of —$OCOR^{15}$ may be the same with each other or different from each other.

The polyol ester represented by the general formula (IV) can be obtained by bringing a polyhydric alcohol represented by the general formula (V):

$$R^{14}(OH)_e \quad (V)$$

(wherein $R^{14}$ and e are the same as those described above) into reaction with a carboxylic acid represented by the general formula (VI):

$$R^{15}COOH \quad (VI)$$

(wherein $R^{15}$ is the same as that described above) or a reactive derivative, such as an ester or a halide, of the carboxylic acid.

Examples of the polyhydric alcohol represented by the above general formula (V) include ethylene glycol, propylene glycol, butylene glycol, neopentyl glycol, trimethylolethane, trimethylolpropane, glycerol, pentaerythritol, dipentaerythritol, and sorbitol. Examples of the carboxylic acid represented by the above general formula (VI) include propionic acid, butyric acid, pivalic acid, valeric acid, caproic acid, heptanoic acid, 3-methylhexanoic acid, 2-ethylhexanoic acid, capric acid, decanoic acid, lauric acid, myristic acid, and palmitic acid.

As (4) the polyether ketone described above, for example, a compound represented by the general formula (VII):

(VII)

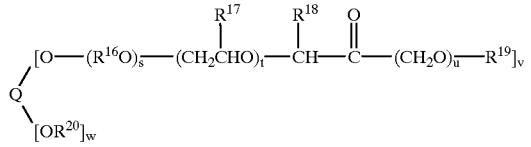

(wherein Q represents a residue group of an alcohol having a functionality of 1 to 8; $R^{16}$ represents an alkylene group having 2 to 4 carbon atoms; $R^{17}$ represents methyl group or ethyl group; $R^{18}$ and $R^{20}$ represent each hydrogen atom, an aliphatic, aromatic, or aromatic-aliphatic hydrocarbon group having 20 or less carbon atoms, and may be the same or different; $R^{19}$ represents an aliphatic, aromatic, or aromatic-aliphatic hydrocarbon group having 20 or less carbon atoms; s and t represent each a number of 0 to 30; v represents a number of 1 to 8, w represents a number of 0 to 7, and v+w is in the range of 1 to 8; and u represents 0 or 1) can be used.

In the above general formula (VII), Q represents a residue group of an alcohol having a functionality of 1 to 8. Examples of the alcohol having Q as the residue group include monohydric alcohols, such as aliphatic monohydric alcohols such as methyl alcohol, ethyl alcohol, linear and branched propyl alcohols, linear and branched butyl alcohols, linear and branched pentyl alcohols, linear and branched hexyl alcohols, linear and branched heptyl alcohols, linear and branched octyl alcohols, linear and branched nonyl alcohols, linear and branched decyl alcohols, linear and branched undecyl alcohols, linear and branched dodecyl alcohols, linear and branched tridecyl alcohols, linear and branched tetradecyl alcohols, linear and branched pentadecyl alcohols, linear and branched hexadecyl alcohols, linear and branched heptadecyl alcohols, linear and branched octadecyl alcohols, linear and branched nonadecyl alcohols, and linear and branched eicosyl alcohols, aromatic alcohols such as phenol, methylphenol, nonylphenol, octylphenol, and naphthol, aromatic-aliphatic alcohols such as benzyl alcohol and phenylethyl alcohol, and compounds obtained by partial etherification of these alcohols; dihydric alcohols, such as linear and branched aliphatic alcohols such as ethylene glycol, propylene glycol, butylene glycol, neopentyl glycol, and tetramethylene glycol, aromatic alcohols such as catechol, resorcinol, bisphenol A, and bisphenyldiol, and compounds obtained by partial etherification of these compounds; trihydric alcohols, such as linear and branched aliphatic alcohols such as glycerol, trimethylolpropane, trimethylolethane, trimethylolbutane, and 1,3,5-pentanetriol, aromatic alcohols such as pyrogallol, methylpyrogallol, and 5-sec-butylpyrogallol, and compound obtained by partial etherification of these alcohols; and alcohols having a functionality of 4 to 8, such as pentaerythritol, diglycerol, sorbitane, triglycerol, sorbitol, dipentaerythritol, tetraglycerol, pentaglycerol, hexaglycerol, tripentaerythritol, and compounds obtained by partial etherification of these alcohols.

In the above general formula (VII), the alkylene group having 2 to 4 carbon atoms which is represented by $R^{16}$ may be linear or branched. Specific examples of the alkylene group include ethylene group, propylene group, ethylethylene group, 1,1-dimethylethylene group, and 1,2-dimethylethylene group. Examples of the aliphatic, aromatic, or aliphatic-aromatic hydrocarbon group having 20 or less carbon atoms which is represented by $R^{18}$ to $R^{20}$ include linear alkyl groups, such as methyl group, ethyl group, propyl group, butyl group, pentyl group, heptyl group, octyl group, nonyl group, decyl group, undecyl group, lauryl group, myristyl group, palmityl group, and stearyl group; branched alkyl groups, such as isopropyl group, isobutyl group, isoamyl group, 2-ethylhexyl group, isostearyl group, and 2-heptylundecyl group; aryl groups, such as phenyl group and methylphenyl group; and arylalkyl groups, such as benzyl group.

In the general formula (VII), s and t represent each a number of 0 to 30. When s or t is more than 30, the contribution of the ether group in the molecule increases, and the polyether ketone is not preferable with respect to the compatibility with hydrofluorocarbon refrigerants, the electric insulating property, and the hygroscopic property. v represents a number of 1 to 8, and w represents a number of 0 to 7. v and w satisfy the relation that v+w is in the range of 1 to 8. These numbers are average numbers and not limited to integers. u represents 0 or 1. A plurality of $R^{16}$ in the number represented by s×v may be the same with each other or different from each other. A plurality of $R^{17}$ in the number represented by t×v may be the same with each other or different from each other. When v represents 2 or more, pluralities of s, t, u, $R^{18}$, and $R^{19}$ each in the number represented by v may be the same with each other or different from each other. When w represents 2 or more, a plurality of $R^{20}$ in the number represented by w may be the same with each other or different from each other.

As the process for producing the polyether ketone represented by the general formula (VII), a generally known process can be used. For example, a process in which a secondary alkyloxyalcohol is oxidized by a hypochlorite and acetic acid (Japanese Patent Application Laid-Open No. Heisei 4(1992)-126716) or a process in which a secondary alkyloxyalcohol is oxidized by zirconium hydroxide and a ketone (Japanese Patent Application Laid-Open No. Heisei 3(1991)-167149) can be used.

As (5) the polyvinyl ether described above, for example, a polyvinyl ether compound having the constituting unit represented by the general formula (VIII):

(VIII)

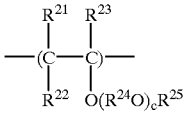

wherein $R^{21}$, $R^{22}$, and $R^{23}$ represent each hydrogen atom or hydrocarbon group having 1 to 8 carbon atoms and may be the same with each other or different from each other; $R^{24}$ represents a divalent hydrocarbon group having 1 to 10 carbon atoms or a divalent hydrocarbon group having 2 to 20 carbon atoms and an oxygen atom of the ether linkage; $R^{25}$ represents a hydrocarbon group having 1 to 20 carbon atoms; c represents a number for each repeating unit, the average of which in the group is 0 to 10; $R^{21}$ to $R^{25}$ in a plurality of constituting units may the same with each other or different from each other; and when a plurality of $R^{24}O$ is contained, $R^{24}O$ may be the same or different) can be used.

A polyvinyl ether compound composed of a block or random copolymer containing the constituting unit represented by the above general formula (VIII) and a constituting unit represented by the general formula (IX):

(IX)

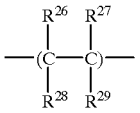

(wherein $R^{26}$ to $R^{29}$ represent each hydrogen atom or a hydrocarbon group having 1 to 20 carbon atoms and may be the same with each other or different from each other, and $R^{26}$ to $R^{29}$ in a plurality of constituting units may be the same with each other or different from each other) can also be used.

In the above general formula (VIII), $R^{21}$, $R^{22}$, and $R^{23}$ represent each hydrogen atom or a hydrocarbon group having 1 to 8 carbon atoms, preferably 1 to 4 carbon atoms, and may be the same with each other or different from each other. Specific examples of the hydrocarbon group include alkyl groups, such as methyl group, ethyl group, n-propyl group, isopropyl group, n-butyl group, isobutyl group, sec-butyl group, tert-butyl group, various types of pentyl group, various types of hexyl group, various types of heptyl group, and various types of octyl group; cycloalkyl groups, such as cyclopentyl group, cyclohexyl group, various types of methylcyclohexyl group, various types of ethylcycohexyl group, and various types of dimethylcyclohexyl group; aryl groups, such as phenyl group, various types of methylphenyl group, various types of ethylphenyl group, and various types of dimethylphenyl group; ad arylakyl groups, such as benzyl group, various types of phenylethyl group and various types of methylbezyl group. As $R^{21}$, $R^{22}$, and $R^{23}$, hydrogen atom is particularly preferable.

In the general formula (VIII), $R^{24}$ represents a divalent hydrocarbon group having 1 to 10 carbon atoms, preferably 2 to 10 carbon atoms, or a divalent hydrocarbon group having 2 to 20 carbon atoms and an oxygen atom of the ether linkage. Specific examples of the divalent hydrocarbon group having 1 to 10 carbon atoms include divalent aliphatic groups, such as methylene group, ethylene group, phenylethylene group, 1,2-propylene group, 2-phenyl-1,2-propylene group, 1,3-propylene group, various types of butylene group, various types of pentylene group, various types of hexylene group, various types of heptylene group, various types of octylene group, various types of nonylene group, and various types of decylene group; alicyclic groups obtained by forming 2 parts for bonding in alicyclic hydrocarbons, such as cyclohexane, methylcyclohexane, ethylcyclohexane, dimethylcyclohexane, and propylcyclohexane; divalent aromatic hydrocarbon groups, such as various types of phenylene group, various types methylphenylene group, various types of ethylphenylene group, various types of dimethylphenylene group, and various types of naphthylene group; alkylaromatic groups having one monovalent part for bonding on each of the alkyl group and the aromatic group in alkylaromatic hydrocarbons, such as toluene, xylene, and ethylbenzene; and alkylaromatic groups having parts for bonding on the alkyl groups in polyalkylaromatic hydrocarbons, such as xylene and diethylbenzene. Among these compounds, aliphatic groups having 2 to 4 carbon atoms are particularly preferable.

Specific examples of the divalent hydrocarbon group having 2 to 20 carbon atoms and an oxygen atom of the ether linkage preferably include methoxymethylene group, methoxyethylene group, methoxymethylethylene group, 1,1-bismethoxymethylethylene group, 1,2-bismethoxymethylethylene group, ethoxymethylethylene group, (2-methoxyethoxy)-methylethylene group, and (1-methyl-2-methoxy)methylethylene group. In the general formula (VIII), c represents the number of repeating of $R^{25}O$, the average of which is a number in the range of 0 to 10, preferably 0 to 5. When a plurality of $R^{24}O$ is contained, $R^{24}O$ may be the same with each other or different from each other.

In the general formula (VIII), $R^{25}$ represents a hydrocarbon group having 1 to 20 carbon atoms, preferably 1 to 10 carbon atom. Specific examples of the hydrocarbon group include alkyl groups, such as methyl group, ethyl group, n-propyl group, isopropyl group, n-butyl group, isobutyl group, sec-butyl group, tert-butyl group, various types of pentyl group, various types of hexyl group, various types of heptyl group, various types of octyl group, various types of nonyl group, and various types of decyl group; cycloalkyl groups, such as cyclopentyl group, cylohexyl group, various types of methylcyclohexyl group, various types of ethylcyclohexyl group, various types of propylcyclohexyl group, and various types of dimethylcyclohexyl group; aryl groups, such as phenyl group, various types of methylphenyl group, various types of ethylphenyl group, various types of dimethylphenyl group, various types of propylphenyl group, various types of trimethylphenyl group, various types of butylphenyl group, and various types of naphthyl group; and arylalkyl groups, such as benzyl group, various types of phenylethyl group, various types of methylbenzyl group, various types of phenylpropyl group, and various types of phenylbutyl group.

$R^{21}$ to $R^{25}$ in a plurality of constituting units may be the same with each other or different from each other.

The polyvinyl ether compound (1) having the constituting unit represented by the general formula (VIII) described above preferably has a carbon/oxygen ratio by mol in the range of 4.2 to 7.0 When the carbon/oxygen ratio by mol is less than 4.2, the polyvinyl ether compound is excessively hygroscopic. When the carbon/oxygen ratio by mol is more than 7.0, the compatibility with hydrofluorocarbon refrigerants is sometimes decreased.

In the general formula (IX) described above, $R^{26}$ to $R^{29}$ represent each hydrogen atom or a hydrocarbon group having 1 to 20 carbon atoms and may be the same with each other or different from each other. Examples of the hydrocarbon group having 1 to 20 carbon atoms include the same groups as those described in the examples of $R^{25}$ in the general formula (VIII) described above. $R^{26}$ to $R^{29}$ in a plurality of constituting units may be the same with each other or different from each other.

The polyvinyl ether compound (2) composed of a block or random copolymer containing the constituting unit represented by the general formula (VIII) described above and the constituting unit represented by the general formula (IX) described above preferably has a carbon/oxygen ratio by mol in the range of 4.2 to 7.0 When the carbon/oxygen ratio by mol is less than 4.2, the polyvinyl ether compound is excessively hygroscopic. When the carbon/oxygen ratio by mol is more than 7.0, the compatibility with hydrofluorocarbon refrigerants is sometimes decreased.

In the present invention, a mixture of the polyvinyl ether compound (1) described above and the polyvinyl ether compound (2) also described above may also be used.

The polyvinyl ether compound (1) and the polyvinyl ether compound (2) used in the present invention can be prepared by polymerization of the corresponding vinyl ether monomer and copolymerization of the corresponding hydrocarbon monomer having an olefinic double bond and the corresponding vinyl ether monomer, respectively.

As the polyvinyl ether compound used in the present invention, the following compounds are preferable. One of the preferable compounds has one end group represented by the general formula (X) or (XI):

(X)

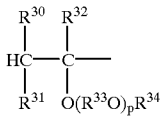

(XI)

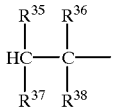

(wherein $R^{30}$, $R^{31}$, and $R^{32}$ represent each hydrogen atom or a hydrocarbon group having 1 to 8 carbon atoms and may be the same with each other of different from each other; $R^{35}$, $R^{36}$, $R^{37}$, and $R^{38}$ represent each hydrogen atom or a hydrocarbon group having 1 to 20 carbon atoms and may be the same with each other or different from each other; $R^{33}$ represents a divalent hydrocarbon group having 1 to 10 carbon atoms or a divalent hydrocarbon group having 2 to 20 carbon atoms and an oxygen atom of the ether leakage; $R^{34}$ represents a hydrocarbon group having 1 to 20 carbon atoms; p represents a number for each repeating unit, the average of which in the group is 0 to 10; and when a plurality of $R^{33}O$ is contained, $R^{33}O$ may be the same with each other or different from each other) and the other end group represented by the general formula (XII) or (XIII):

(XII)

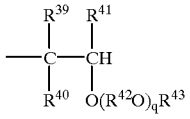

(XIII)

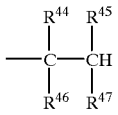

(wherein $R^{39}$, $R^{40}$, and $R^{41}$ represent each hydrogen atom or a hydrocarbon group having 1 to 8 carbon atoms and may be the same with each other or different from each other; $R^{44}$, $R^{45}$, $R^{46}$, and $R^{47}$ represent each hydrogen atom or a hydrocarbon group having 1 to 20 carbon atoms and may be the same with each other or different from each other; $R^{42}$ represents a divalent hydrocarbon group having 1 to 10 carbon atoms or a divalent hydrocarbon group having 2 to 20 carbon atoms and an oxygen atom of the ether linkage; $R^{43}$ represents a hydrocarbon group having 1 to 20 carbon atoms; q represents a number for each repeating unit, the average of which is in the range of 0 to 10; and when a plurality of $R^{42}O$ is contained, $R^{42}O$ may be the same with each other or different from each other).

Another of the preferable compounds has one end group represented by the general formula (XII) or (XIII) described above and the other end group represented by the general formula (XIV):

(XIV)

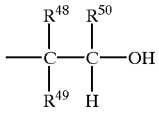

(wherein $R^{43}$, $R^{49}$, and $R^{50}$ represent each hydrogen atom or a hydrocarbon group having 1 to 8 carbon atoms and may be the same with each other or different from each other).

Among the polyvinyl ether compounds described above, the following compounds are particularly preferable as the base oil of the refrigerator oil of the present invention.

(1) Compounds in which one end group has the structure represented by the general formula (X) or (XI), the other end group has the structure represented by the general formula (XII) or (XIII), and in the general formula (VIII), $R^{21}$, $R^{22}$, and $R^{23}$ represent all hydrogen atoms, c represents a number of 0 to 4, $R^{24}$ represents a divalent hydrocarbon group having 2 to 4 carbon atoms, and $R^{25}$ represents a hydrocarbon group having 1 to 20 carbon atoms.

(2) Compounds having the constituting unit represented by the general formula (VIII) alone, in which one end group has the structure represented by the general formula (X), the other end group has the structure represented by the general formula (XII), and in the general formula (VIII), $R^{21}$, $R^{22}$, and $R^{23}$ represent all hydrogen atoms, c represents a number of 0 to 4, $R^{24}$ represents a divalent hydrocarbon group having 2 to 4 carbon atoms, and $R^{25}$ represents a hydrocarbon group having 1 to 20 carbon atoms.

(3) Compounds in which one end group has the structure represented by the general formula (X) or (XI), the other end group has the structure represented by the general formula (XIV), and in the general formula (VIII), $R^{21}$, $R^{22}$, and $R^{23}$ represent all hydrogen atoms, c represents a number of 0 to 4, $R^{24}$ represents a divalent hydrocarbon group having 2 to 4 carbon atoms, and $R^{25}$ represents a hydrocarbon group having 1 to 20 carbon atoms.

(4) Compounds having the constituting unit represented by the general formula (VIII) alone, in which one end group has the structure represented by the general formula (X), the other end group has the structure represented by the general formula (XIII), and in the general formula (VIII), $R^{21}$, $R^{22}$, and $R^{23}$ represent all hydrogen atoms, c represents a number of 0 to 4, $R^{24}$ represents a divalent hydrocarbon group having 2 to 4 carbon atoms, and $R^{25}$ represents a hydrocarbon group having 1 to 20 carbon atoms.

In the present invention, a polyvinyl ether compound having the constituting unit represented by the general formula (VIII) described above, one end group represented by the general formula (X), and the other end group represented by the general formula (XV):

(XV)

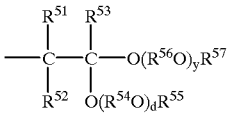

(wherein $R^{51}$, $R^{52}$, and $R^{53}$ represent each hydrogen atom or a hydrocarbon group having 1 to 8 carbon atoms and may be the same with each other or different from each other; $R^{54}$ and $R^{56}$ represent each a divalent hydrocarbon group having 2 to 10 carbon atoms and may be the same or different; $R^{55}$ and $R^{57}$ represent each a hydrocarbon group having 1 to 10 carbon atoms; d and y represent each a number for each repeating unit, the average of which in the group is 0 to 10, and may be the same or different; $R^{54}O$ may be the same or different when a plurality of $R^{54}O$ are contained; and $R^{56}O$ may be the same or different when a plurality of $R^{56}O$ are contained) can also be used. Furthermore, in the present invention, a polyvinyl ether compound composed of a homopolymer or a copolymer of an alkyl vinyl ether having the constituting unit represented by the general formula (XVI) or (XVII):

(XVI)

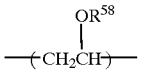

(XVII)

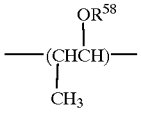

(wherein $R^{58}$ represents a hydrocarbon group having 1 to 8 carbon atoms), a molecular weight of 300 to 1,200, and one end group represented by the general formula (XVIII) or (XIX):

(XVIII)

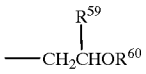

(XIX)

(wherein $R^{59}$ represents an alkyl group having 1 to 3 carbon atoms, and $R^{60}$ represents a hydrocarbon group having 1 to 8 carbon atoms) can also be used.

As the polyvinyl ether compound, compounds described in the specifications of Japanese Patent Application Laid-Open No. Heisei 6(1994)-128578, Japanese Patent Application No. Heisei 5(1993)-125649 (Laid-Open No. Heisei 6(1994)-234814), Japanese Patent Application No. Heisei 5(1993)-125650 (Laid-Open No. Heisei 6(1994)-234815), Japanese Patent Application No. Heisei 5(1993)-303736, Japanese Patent Application No. Heisei 6(1994)-280371, and Japanese Patent Application No. Heisei 6(1994)-283349, in detail can also be used.

As (6) the carbonate derivative described above, for example, a polycarbonate represented by the general formula (XX):

(XX)

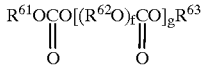

(wherein $R^{61}$ and $R^{63}$ represent each a hydrocarbon group having 30 or less carbon atoms or a hydrocarbon group having 2 to 30 carbon atoms and an ether linkage and may be the same or different, $R^{62}$ represents an alkylene group having 2 to 24 carbon atoms, f represents an integer of 1 to 100, and g represents an integer of 1 to 10 ) can be used.

In the above general formula (XX), $R^{61}$ and $R^{63}$ represent each a hydrocarbon group having 30 or less carbon atoms or a hydrocarbon group having 2 to 30 carbon atoms and an ether linkage. Specific examples of the hydrocarbon group having 30 or less carbon atoms include aliphatic hydrocarbon groups, such as methyl group, ethyl group, n-propyl group, isopropyl group, n-butyl group, isobutyl group, s-butyl group, t-butyl group, pentyl group, isopentyl group, neopentyl group, n-hexyl group, 1,3-dimethylbutyl group, 2,3-dimethylbutyl group, isohexyl group, n-heptyl group, isoheptyl group, 3-methylhexyl group, n-octyl group, 2-ethylhexyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonadecyl group, isononadecyl group, n-eicosyl group, isoeicosyl group, and 2-(4-methylpentyl) group; alicyclic hydrocarbon groups, such as cyclohexyl group, 1-cyclohexenyl group, methylcyclohexyl group, dimethylcyclohexyl group, decahydronaphthyl group, and tricyclodecanyl group; aromatic hydrocarbon groups, such as phenyl group, o-tolyl group, p-tolyl group, m-tolyl group, 2,4-xylyl group, mesityl group, and 1-naphthyl group; and aromatic-aliphatic hydrocarbons, such as benzyl group, methylbenzyl group, β-phenylethyl group (phenethyl group), 1-phenylethyl group, 1-methyl-1-phenylethyl group, p-methylbenzyl group, styryl group, and cinnamyl group.

As the hydrocarbon group having 2 to 30 carbon atoms and an ether linkage, for example, a glycol ether group represented by the general formula (XXI):

$$-(R^{64}-O)_h-R^{65} \quad \text{(XXI)}$$

(wherein $R^{64}$ represents an alkylene group having 2 or 3 carbon atoms, such as ethylene group, propylene group, and trimethylene group, $R^{65}$ represents an aliphatic, alicyclic, or aromatic hydrocarbon group having 28 or less carbon atoms, such as the groups described as examples of the group represented by $R^{61}$ and $R^{63}$, and h represents an integer of 1 to 20) can be used. Specific examples of the glycol ether group represented by the general formula (XXI) include ethylene glycol monomethyl ether group, ethylene glycol monobutyl ether group, diethylene glycol mono-n-butyl ether group, triethylene glycol monoethyl ether group, propylene glycol monomethyl ether group, propylene glycol monobutyl ether group, dipropylene glycol monoethyl ether group, and tripropylene glycol mono-n-butyl ether group. Among the groups described above, alkyl groups, such as n-butyl group, isobutyl group, isoamyl group, cyclohexyl group, isoheptyl group, 3-methylhexyl group, 1,3-dimethylbutyl group, hexyl group, octyl group, and 2-ethylhexyl group; and alkylene glycol monoalkyl ether groups, such as ethylene glycol monomethyl ether group, ethylene glycol monobutyl ether group, diethylene glycol monomethyl ether group, triethylene glycol monomethyl group, propylene glycol monomethyl ether group, propylene glycol monobutyl ether group, dipropylene glycol monoethyl ether group, and tripropylene glycol mono-n-butyl ether group; are preferable.

$R^{68}$ and $R^{63}$ described above may be the same or different.

In the above general formula (XX), $R^{62}$ represents an alkylene group having 2 to 24 carbon atoms. Specific examples of the alkylene group include ethylene group, propylene group, butylene group, amylene group, methylamylene group, ethylamylene group, hexylene group, methylhexylene group, ethylhexylene group, octamethylene group, nonamethylene group, decamethylene group, dodecamethylene group, and tetradecamethylene group. f represents an integer of 1 to 100, and g represents an integer of 1 to 10 . When a plurality of $R^{62}O$ are contained, $R^{62}O$ may be the same with each other or different from each other.

The polycarbonate represented by the general formula (XX) preferably has a molecular weight (a weight-average molecular weight) of 300 to 3,000, more preferably 400 to 1,500. When the molecular weight is less than 300, the polycarbonate has a kinematic viscosity smaller than the desirable range and is not preferable as lubricant. When the molecular weight is more than 3,000, the polycarbonate becomes waxy, and the application as lubricant is difficult.

The polycarbonate can be produced in accordance with various processes and is generally produced by using a carbonic acid diester or a derivative which can form a carbonic acid ester such as phosgen, and an aliphatic dihydric alcohol as the materials.

For producing the polycarbonate from the above materials, a conventional process for producing a polycarbonate can be used. In general, the transesterification process or the phosgen process can be used.

As the polycarbonate, the compounds described in the specification of Japanese Patent Application Laid-Open No. Heisei 3(1991)-217495 in detail can also be used.

As the carbonate derivative, a glycol ether carbonate represented by the general formula (XXII):

$$R^{66}—O—(R^{68}O)_i—CO—(OR^{69})_j—O—R^{67} \quad \text{(XXII)}$$

(wherein $R^{66}$ and $R^{67}$ represent each an aliphatic, alicyclic, aromatic, or aromatic-aliphatic hydrocarbon group having 1 to 20 carbon atoms and may be the same with each other or different from each other, $R^{68}$ and $R^{69}$ represent each ethylene group or isopropylene group and may be the same or different, and i and j represent each a number of 1 to 100) can also be used.

In the above general formula (XXII), specific examples of the aliphatic hydrocarbon group represented by $R^{66}$ and $R^{67}$ include methyl group, ethyl group, propyl group, isopropyl group, isobutyl group, s-butyl group, t-butyl group, pentyl group, isopentyl group, neopentyl group, n-hexyl group, isohexyl group, n-heptyl group, isoheptyl group, n-octyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonyldecyl group, isononyldecyl group, n-eicosyl group, and isoeicosyl group. Specific examples of the alicyclic hydrocarbon group include cyclohexyl group, 1-cyclohexenyl group, methylcyclohexyl group, dimethylcyclohexyl group, decahydronaphthyl group, and tricyclodecanyl group. Specific examples of the aromatic hydrocarbon group include phenyl group, o-tolyl group, p-tolyl group, m-tolyl group, 2,4-xylyl group, mesityl group, and 1-naphthyl group. Specific examples of the aromatic-aliphatic hydrocarbon group include benzyl group, methylbenzyl group, phenylethyl group, styryl group, and cinnamyl group.

The glycol ether carbonate represented by the above general formula (XXII) can be produced, for example, by transesterification of a polyalkylene glycol monoalkyl ether in the presence of an excess amount of a carbonic acid ester of an alcohol having a relatively low boiling point.

As the glycol ether carbonate described above, compounds described in the specification of Japanese Patent Application Laid-Open No. Heisei 3(1991)-149295 in detail can also be used.

As the carbonate derivative, a carbonic acid ester represented by the general formula (XXIII):

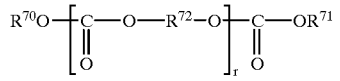

(XXIII)

(wherein $R^{70}$ and $R^{71}$ represent each an alkyl group having 1 to 15 carbon atoms or a residue group of a dihydric alcohol having 2 to 12 carbon atoms and may be the same or different, $R^{72}$ represents an alkylene group having 2 to 12 carbon atoms, and r represents an integer of 0 to 30) can also be used.

In the above general formula (XXIII), $R^{70}$ and $R^{71}$ represent each an alkyl group having 1 to 15 carbon atoms, preferably 2 to 9 carbon atoms, or a residue group of a dihydric alcohol having 2 to 12 carbon atoms, preferably 2 to 9 carbon atoms, $R^{72}$ represents an alkylene group having 2 to 12 carbon atoms, preferably 2 to 9 carbon atoms, and r represents an integer of 0 to 30, preferably 1 to 30. A carbonic acid ester which does not satisfy the above condition is not preferable because the product obtained by using it is inferior in various properties, such as the compatibility with hydrofluorocarbon refrigerants. Specific examples of the alkyl group having 1 to 15 carbon atoms which is represented by $R^{70}$ and $R^{71}$ include methyl group, ethyl group, n-propyl group, n-butyl group, n-pentyl group, n-hexyl group, n-heptyl group, n-octyl group, n-nonyl group, n-decyl group, n-undecyl group, n-dodecyl group, n-tridecyl group, n-tetradecyl group, n-pentadecyl group, isopropyl group, isobutyl group, tert-butyl group, isopentyl group, isohexyl group, isoheptyl group, isooctyl group, isononyl group, isodecyl group, isoundecyl group, isododecyl group, isotridenyl group, isotetradecyl group, and isopentadecyl group.

Specific examples of the residue group of a dihydric alcohol having 2 to 12 carbon atoms include residue groups formed from ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol.

Specific examples of alkylene group having 2 to 12 carbon atoms which is represented by $R^{72}$ include alkylene groups having linear structures and branched structures, such as ethylene group, trimethylene group, propylene group, tetramethylene group, butylene group, 2-methyltrimethylene group, pentamethylene group, 2,2-dimethyltrimethylene group, hexamethylene group, 2-ethyl-2-methyltrimethylene group, heptamethylene group, 2-methyl-2-propyltrimethylene group, 2,2-diethyltrimethylene group, octamethylene group, nonamethylene group, decamethylene group, undecamethylene group, and dodecamethylene group.

The molecular weight of the carbonic acid ester described above is not particularly limited. Carbonic acid esters having a number-average molecular weight of 200 to 3,000 is preferably used because of the superior property of sealing the compressor. Carbonic acid esters having the number-average molecular weight of 300 to 2,000 is more preferably used.

As the carbonic acid ester described above, compounds described in the specification of Japanese Patent Application Laid-Open No. Heisei 4(1992)-63893 in detail can also be used.

Among the oxygen-containing compounds described above, polyalkylene glycols, polyol esters, and polyvinyl ethers are particularly preferable because of superior compatibility with hydrofluorocarbon refrigerants and superior effect of suppressing the foaming phenomenon. The oxygen-containing organic compound may be used singly or as a combination of two or more types.

The refrigerator oil of the present invention can be used for refrigerators using various types of refrigerant, and preferably for refrigerators using a hydrofluorocarbon refrigerant. Examples of the hydrofluorocarbon refrigerant include 1,1,1,2-tetrafluoroethane (R134a), 1,1,2,2-tetrafluoroethane (R134), 1,1,1-trifluoroethane (R143a), 1,1-difluoroethane (R152a), pentafluoroethane (R125), difluoromethane (R32), trifluoromethane (R23), and mixtures of these compounds. When the refrigerator oil of the present invention is applied to a refrigeration system using a refrigerant containing 1,1,1,2-tetrafluoroethane alone, a mixed refrigerant containing difluoromethane, or a mixed refrigerant containing 2-tetrafluoroethane, particularly superior effect of suppressing the foaming phenomenon can be exhibited. Specific examples of the mixed refrigerants include R407c (a mixture of R134a, R125, and R32), R404a (a mixture of R134a, R125, and R143a), R410a (a mixture of R32 and R125), and a mixture of R32 and R134a.

The refrigerator oil of the present invention can also be used for refrigerators using a refrigerant other than the hydrofluorocarbon refrigerants described above. Examples of the refrigerant other than the hydrofluorocarbon refrigerants include ethers having 2 to 8 carbon atoms (preferably, dimethyl ether, diethyl ether, and methyl ethyl ether), ammonia, carbon dioxide, and hydrocarbons having 1 to 8 carbon atoms such as alkanes and alkenes (preferably hydrocarbons having 3 or 4 carbon atoms such as propane and butane). The refrigerant can be used as a mixture of two or more types. For example, a mixture of a hydrofluorocarbon refrigerant and a refrigerant other than the hydrofluorocarbon refrigerants can be used. Two or more types of refrigerant other than the hydrofluorocarbon refrigerants can also be selected suitably and used in combination.

To the refrigerator oil of the present invention, various conventional additives, such as extreme pressure agents such as phosphoric acid esters and phosphorous acid esters, phenol antioxidants, amine antioxidants, stabilizers such as phenyl glycidyl ether, cyclohexene oxide, epoxidized soy bean oil, and other epoxy compounds, and inactivating agents for copper such as benzotriazole and derivatives of benzotriazole, can suitably be added if necessary.

The present invention also provides a process for lubrication of a refrigeration system in which the lubrication is achieved by using the refrigerator oil containing the fluorinated silicone oil described above in a compression-type refrigeration system, particularly in a compression type refrigeration system using a hydrofluorocarbon refrigerant. In accordance with the above process, the foaming phenomenon occurring during boiling of the refrigerant dissolved in the refrigerator oil can be suppressed to prevent flowing out of a large amount of the refrigerator oil into the system, and the excellent performance of the refrigeration system can be maintained.

The present invention is described in more detail with reference to examples. However, the present invention is not limited by the examples.

Example 1 to 30 and Comparative Examples 1 to 18

Into a pressure resistant glass vessel having an inner diameter of 55 mm and a height of 30 cm, a refrigerator oil and a refrigerant shown in Table 1 in an amounts of 75 ml each were placed. While the mixture was stirred well (1380 rpm) with a propeller at a room temperature under an equilibrium pressure of the refrigerant, the pressure inside of the vessel was rapidly reduced to an atmospheric pressure. The height of the foam formed by the reduction in the pressure was measured. The result was evaluated in accordance with the following criterion.

Criterion for Evaluation of the Result

◎: The height of foam was 5 cm or less.

○: The height of foam was more than 5 cm and 10 cm or less.

Δ: The height of foam was more than 10 cm and 20 cm or less.

×: The height of foam was more than 20 cm.

As the base oil, the defoaming agent, and the refrigerant, the following materials were used.

(1) Base Oil ester oil: a carboxylic acid ester of pentaerythritol (VG32 and VG68)

PVE oil: polyvinyl ether oil (VG68)

PAG oil: a modified polyalkylene glycol oil containing oxypropylene group and oxyethylene group in the main chain (VG46)

polycarbonate oil: (VG56)

alkylbenzene oil: (VG56)

PAO oil: poly-α-olefin (VG68)

mineral oil: (VG32)

The mark in the parenthesis in the above base oils shows the grade in accordance with Japanese Industrial Standard.

(2) Defoaming Agent

A: $R^1$ to $R^7$: methyl group, $R^8$: fluorinated propyl group kinematic viscosity: 500 $mm^2$/sec (25° C.)

B: $R^1$ to $R^7$: methyl group, $R^8$: fluorinated propyl group kinematic viscosity: 1,000 $mm^2$/sec (25° C.)

C: $R^1$ to $R^7$: methyl group, $R^8$: fluorinated propyl group kinematic viscosity: 10,000 $mm^2$/sec (25° C.)

D: $R^1$ to $R^6$: methyl group, $R^7$ and $R^8$: fluorinated propyl group kinematic viscosity: 1,000 $mm^2$/sec (25° C.)

E: $R^1$ to $R^5$: methyl group, $R^6$ to $R^8$: fluorinated propyl group kinematic viscosity: 1,000 $mm^2$/sec (25° C.)

F: $R^1$ to R3 and $R^5$ to $R^7$: methyl group, $R^4$: fluorinated hexyl group, $R^8$: fluorinated propyl group, kinematic viscosity: 1,000 $mm^2$/sec (25° C.)

G: $R^1$ to $R^7$: methyl group, $R^8$: fluorinated propyl group kinematic viscosity: 170 $mm^2$/sec (25° C.)

The above oils are the fluorinated silicone oils represented by the general formula (I).

H: silicone oil (dimethylsiloxane) kinematic viscosity: 10,000 $mm^2$/sec (25° C.)

I: silicone oil (dimethylsiloxane) kinematic viscosity: 100, 000 $mm^2$/sec (25° C.)

(3) Refrigerant

R134a: 1,1,1,2-tetrafluoroethane

R407c: a mixture of 1,1,1,2-tetrafluoroethane, pentafluoroethane, and difluoromethane R22: chlorodifluoromethane

TABLE 1 - 1

| | refrigerator oil | | | | |
|---|---|---|---|---|---|
| | | defoaming agent | | type | result |
| Example | type of base oil | type | (ppm by weight) | of refrigerant | of evaluation |
| 1 | ester oil (VG32) | B | 100 | R134a | ◎ |
| 2 | ester oil (VG32) | D | 100 | R134a | ◎ |
| 3 | ester oil (VG32) | E | 100 | R134a | ◎ |
| 4 | ester oil (VG32) | F | 100 | R134a | ◎ |
| 5 | ester oil (VG68) | A | 100 | R407c | ◎ |
| 6 | ester oil (VG68) | B | 100 | R407c | ◎ |
| 7 | ester oil (VG68) | C | 100 | R407c | ◎ |
| 8 | ester oil (VG68) | D | 100 | R407c | ◎ |
| 9 | ester oil (VG68) | E | 100 | R407c | ◎ |
| 10 | ester oil (VG68) | F | 100 | R407c | ◎ |
| 11 | PVE oil (VG68) | B | 100 | R134a | ◎ |
| 12 | PVE oil (VG68) | D | 100 | R134a | ◎ |
| 13 | PVE oil (VG68) | E | 100 | R134a | ◎ |
| 14 | PVE oil (VG68) | F | 100 | R134a | ◎ |
| 15 | PVE oil (VG68) | C | 100 | R32 | ◎ |
| 16 | PVE oil (VG68) | C | 100 | R32/R134a (3/7) | ◎ |

TABLE 1 - 2

| | refrigerator oil | | | | |
|---|---|---|---|---|---|
| | | defoaming agent | | type | result |
| Example | type of base oil | type | (ppm by weight) | of refrigerant | of evaluation |
| 17 | PVE oil (VG68) | A | 1000 | R407c | ◎ |
| 18 | PVE oil (VG68) | B | 100 | R407c | ◎ |
| 19 | PVE oil (VG68) | C | 10 | R407c | ◎ |
| 20 | PVE oil (VG68) | D | 100 | R407c | ◎ |
| 21 | PVE oil (VG68) | E | 100 | R407c | ◎ |
| 22 | PVE oil (VG68) | F | 100 | R407c | ◎ |
| 23 | PAG oil (VG46) | B | 100 | R134a | ◎ |
| 24 | PAG oil (VG46) | D | 100 | R134a | ◎ |
| 25 | PAG oil (VG46) | E | 100 | R134a | ◎ |
| 26 | PAG oil (VG46) | F | 100 | R134a | ◎ |
| 27 | polycarbonate oil (VG46) | B | 100 | R134a | ◎ |
| 28 | polycarbonate | D | 100 | R134a | ◎ |

TABLE 1 - 2-continued

| | refrigerator oil | | | | |
|---|---|---|---|---|---|
| | | defoaming agent | | type | result |
| Example | type of base oil | type | (ppm by weight) | of refrigerant | of evaluation |
| 29 | oil (VG46) polycarbonate oil (VG46) | E | 100 | R134a | ◎ |
| 30 | polycarbonate oil (VG46) | F | 100 | R134a | ◎ |

TABLE 1 - 3

| | refrigerator oil | | | | |
|---|---|---|---|---|---|
| | | defoaming agent | | type | result |
| Comparative Example | type of base oil | type | (ppm by weight) | of refrigerant | of evaluation |
| 1 | PVE oil (VG68) | H | 10 | R22 | ○ |
| 2 | ester oil (VG68) | H | 10 | R22 | ○ |
| 3 | PVE oil (VG68) | — | — | R407c | x |
| 4 | PVE oil (VG68) | I | 100 | R407c | x |
| 5 | ester oil (VG68) | — | — | R407c | x |
| 6 | ester oil (VG68) | I | 100 | R407c | x |
| 7 | PAG oil (VG46) | I | 100 | R407c | x |
| 8 | polycarbonate oil (VG56) | I | 100 | R407c | x |
| 9 | PVE oil (VG68) | H | 10 | R134a | x |
| 10 | ester oil (VG32) | H | 10 | R134a | x |
| 11 | PVE oil (VG68) | G | 100 | R407c | x |
| 12 | PVE oil (VG68) | G | 10,000 | R407c | x |
| 13 | alkylbenzene oil (VG56) | B | 100 | R407c | x |
| 14 | PAO oil (VG68) | B | 100 | R407c | x |
| 15 | PVE oil (VG68) | A | 100 | R22 | Δ |
| 16 | PVE oil (VG68) | B | 100 | R22 | Δ |
| 17 | PVE oil (VG68) | C | 100 | R22 | Δ |
| 18 | mineral oil | I | 100 | R22 | ○ |

INDUSTRIAL APPLICABILITY

The refrigerator oil of the present invention can effectively suppress the foaming phenomenon during boiling of a refrigerant which is dissolved in the refrigerator oil, and used in combination with various types of refrigerant, particularly refrigerants composed of a single type of hydrofluorocarbon or mixed refrigerants composed of two or more types of hydrofluorocarbon. By using the refrigerator oil of the present invention as the lubricant in a compression-type refrigeration system, the excellent performance of the refrigeration system can be maintained.

I claim:

1. A refrigerator oil comprising a base oil composed of an oxygen-containing organic compound and a fluorinated silicone oil having a kinematic viscosity of 500 $mm^2$/sec or more at 25° C., wherein the oxygen-containing organic compound is polyalkylene glycol, a polyester, a polyether ketone, a polyvinyl ether, or a carbonate derivative, wherein the fluorinated silicone oil is a compound having the structure represented by the general formula (I):

(I)

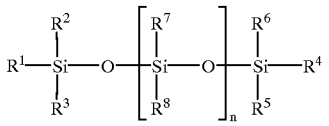

wherein $R^1$ to $R^6$ represent each hydrogen atom or a hydrocarbon group, and may be the same with each other or different from each other; $R^7$ and $R^8$ represent each a hydrocarbon group or a fluorinated hydrocarbon group, at least one of $R^7$ and $R^8$ is a fluorinated hydrocarbon, and $R^7$ and $R^8$ in a plurality of repeating units may be the same with each other or different from each other; and n represents an integer which is selected in such a manner that the fluorinated silicone oil has a kinematic viscosity of 500 $mm^2$/sec or more at 25° C., and wherein the content of the fluorinated silicone oil in the refrigerator oil is 1 to 6,000 ppm by weight.

2. A refrigerator oil according to claim 1, wherein the product of the kinematic viscosity ($mm^2$/sec) at 25° C. of the fluorinated silicone oil and the content (ppm by weight) of the fluorinated silicone oil in the refrigerator oil is 50,000 to 3,000,000.

3. A process for lubrication of a refrigeration system comprising lubricating a compression-type refrigeration system by using the refrigerator oil described in claim 1.

4. A refrigerator oil comprising a base oil composed of an oxygen-containing organic compound and a fluorinated silicone oil having a kinematic viscosity of 500 $mm^2$/sec or more at 25° C., wherein the oxygen-containing organic compound is a polyester, a polyether ketone, a polyvinyl ether, or a carbonate derivative, wherein the fluorinated silicone oil is a compound having the structure represented by the general formula (I):

(I)

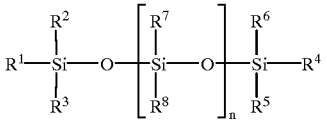

wherein $R^1$ to $R^6$ represent each hydrogen atom or a hydrocarbon group, and may be the same with each other or different from each other; $R^7$ and $R^8$ represent each a hydrocarbon group or a fluorinated hydrocarbon group, at least one of $R^7$ and $R^8$ is a fluorinated hydrocarbon, and $R^7$ and $R^8$ in a plurality of repeating units may be the same with each other or different from each other; and n represents an integer which is selected in such a manner that the fluorinated silicone oil has a kinematic viscosity of 500 $mm^2$/sec or more at 25° C., and wherein the content of the fluorinated silicone oil in the refrigerator oil is 1 to 6,000 ppm by weight.

* * * * *